US006320501B1

(12) United States Patent
Tice et al.

(10) Patent No.: US 6,320,501 B1
(45) Date of Patent: Nov. 20, 2001

(54) MULTIPLE SENSOR SYSTEM FOR ALARM DETERMINATION WITH DEVICE-TO-DEVICE COMMUNICATIONS

(75) Inventors: Lee D. Tice, Bartlett; Manley S. Keeler, Naperville; Robert J. Clow, Aurora; Tarek Farag, St. Charles; Jerry L. Howard, Herscher, all of IL (US)

(73) Assignee: Pittway Corporation, Chicago, IL (US)

( * ) Notice: Subject to any disclaimer, the term of this patent is extended or adjusted under 35 U.S.C. 154(b) by 0 days.

(21) Appl. No.: 09/318,304

(22) Filed: May 25, 1999

(51) Int. Cl.[7] ..... G08B 23/00

(52) U.S. Cl. ..... 340/517; 340/501; 340/505; 340/506; 340/522; 340/524; 340/525; 340/587

(58) Field of Search ..... 340/517, 501, 340/505, 506, 522, 524, 525, 587

(56) References Cited

U.S. PATENT DOCUMENTS

| | | | |
|---|---|---|---|
| 3,328,772 | 6/1967 | Oeters | 711/167 |
| 3,654,610 | 4/1972 | Sander et al. | 365/49 |
| 3,691,528 | 9/1972 | Calvagna et al. | 340/3.53 |
| 3,699,523 | 10/1972 | Percher | 340/870.15 |
| 3,723,974 | 3/1973 | Holtz | 710/15 |
| 4,016,548 | 4/1977 | Law et al. | 370/476 |
| 4,017,839 | 4/1977 | Calle et al. | 710/51 |
| 4,124,889 | 11/1978 | Kaufman et al. | 710/2 |
| 4,131,881 | 12/1978 | Robinson | 714/806 |
| 4,134,103 | 1/1979 | Huxtable et al. | 710/60 |
| 4,143,418 | 3/1979 | Hodge et al. | 700/293 |
| 4,161,027 | 7/1979 | Russell | 700/293 |
| 4,219,875 | 8/1980 | Templeton | 713/502 |
| 4,271,505 | 6/1981 | Menot et al. | 370/400 |
| 4,296,464 | 10/1981 | Woods et al. | 710/126 |
| 4,332,027 | 5/1982 | Malcolm et al. | 370/448 |

(List continued on next page.)

FOREIGN PATENT DOCUMENTS 0 419 668 A1 3/1991 (EP) .

OTHER PUBLICATIONS

Host Groups: A Multicast Extension for Datagram Internetworks D. Cheriton, S. Deering, Published in IEEE Computer Society and ACM Conference on Communications, Sep. 1985.

VMTP: A Transport Protocol for the next Generation of Communication Systems, D. Cheriton, ACM Conference on Communications, 1886.

(List continued on next page.)

*Primary Examiner*—Daryl Pope
(74) *Attorney, Agent, or Firm*—Rockey, Milnamow & Katz, Ltd.

(57) ABSTRACT

A multi-unit ambient condition detecting system incorporates either a wired or a wireless communication medium wherein the units are in bi-directional communication with one another. Units can incorporate programmed processors and ambient condition sensors such as smoke or gas sensors. In response to detected local ambient conditions, the respective units can transmit messages indicative of the level of sensed ambient condition to other units in the system. The units can maintain running totals of levels of ambient conditions received from other units in the system and combine those received indicators, along with one or more locally generated indicators, to determine that a selected condition, such as fire or gas is present in at least a portion of the region being monitors. Output devices coupled to the communication medium can provide human discernable audible or visible indicators of the presence of one or more selected conditions.

81 Claims, 3 Drawing Sheets

U.S. PATENT DOCUMENTS

| | | | |
|---|---|---|---|
| 4,399,531 | 8/1983 | Grande et al. | 370/216 |
| 4,415,896 | 11/1983 | Allgood | 340/870.03 |
| 4,427,968 | 1/1984 | York | 340/310.07 |
| 4,445,214 | 4/1984 | Reynolds et al. | 370/389 |
| 4,495,574 | 1/1985 | Hofstetter | 710/131 |
| 4,516,273 | 5/1985 | Gregory et al. | 2/462 |
| 4,527,267 | 7/1985 | Cohen | 370/231 |
| 4,528,663 | 7/1985 | Citta | 370/229 |
| 4,532,625 | 7/1985 | Stover | 370/225 |
| 4,535,450 | 8/1985 | Tan | 370/461 |
| 4,539,652 | 9/1985 | Rubin | 710/100 |
| 4,551,834 | 11/1985 | Lienard | 370/394 |
| 4,594,708 | 6/1986 | Servel et al. | 370/395 |
| 4,596,025 | 6/1986 | Satoh | 375/356 |
| 4,597,078 | 6/1986 | Kempf | 370/401 |
| 4,607,256 | 8/1986 | Henzel | 340/825.05 |
| 4,622,550 | 11/1986 | O'Conner et al. | 370/452 |
| 4,627,051 | 12/1986 | Shimizu | 370/455 |
| 4,627,052 | 12/1986 | Hoare et al. | 370/402 |
| 4,637,022 | 1/1987 | Burke et al. | 714/784 |
| 4,639,921 | 1/1987 | Gang et al. | 714/807 |
| 4,653,048 | 3/1987 | Anderson et al. | 714/49 |
| 4,658,353 | 4/1987 | Whittaker et al. | 709/253 |
| 4,667,193 | 5/1987 | Cotie et al. | 340/825.08 |
| 4,672,373 | 6/1987 | Mori et al. | 340/825.16 |
| 4,675,803 | 6/1987 | Kendall | 700/2 |
| 4,689,785 | 8/1987 | Toyonaga et al. | 370/448 |
| 4,689,786 | 8/1987 | Sudhu et al. | 370/255 |
| 4,697,094 | 9/1987 | Palazzeti | 307/40 |
| 4,712,214 | 12/1987 | Meltzer et al. | 714/748 |
| 4,712,215 | 12/1987 | Joshi et al. | 714/776 |
| 4,716,575 | 12/1987 | Douros et al. | 375/212 |
| 4,719,621 | 1/1988 | May | 370/402 |
| 4,736,409 | 4/1988 | Hasegawa et al. | 379/269 |
| 4,745,593 | 5/1988 | Stewart | 370/244 |
| 4,748,620 | 5/1988 | Adelmann et al. | 370/394 |
| 4,756,007 | 7/1988 | Qureshi et al. | 375/259 |
| 4,761,646 | 8/1988 | Choquet et al. | 340/825.52 |
| 4,771,286 | 9/1988 | Niessen et al. | 340/825.52 |
| 4,779,087 | 10/1988 | Fukuda et al. | 370/223 |
| 4,792,941 | 12/1988 | Yanosy, Jr. et al. | 370/232 |
| 4,797,881 | 1/1989 | Ben-Artzi | 370/402 |
| 4,802,189 | 1/1989 | Wedler | 375/259 |
| 4,807,224 | 2/1989 | Naron et al. | 370/218 |
| 4,835,706 | 5/1989 | Asahi | 700/293 |
| 4,839,887 | 6/1989 | Yano | 370/396 |
| 4,847,834 | 7/1989 | Bryant | 370/449 |
| 4,918,690 | 4/1990 | Markkula, Jr. et al. | 340/825.53 |
| 4,924,458 | 5/1990 | Obara | 370/58 |
| 4,930,124 | 5/1990 | de Boisseron et al. | 370/400 |
| 4,933,846 | 6/1990 | Humphrey et al. | 710/107 |
| 4,949,083 | 8/1990 | Hirabaysahi et al. | 370/452 |
| 4,956,772 | 9/1990 | Neches | 709/313 |
| 5,010,477 | 4/1991 | Omoda et al. | 712/4 |
| 5,016,159 | 5/1991 | Maruyama | 370/390 |
| 5,228,127 | 7/1993 | Ikeda et al. | 709/225 |
| 5,341,504 | 8/1994 | Mori et al. | 712/12 |
| 5,400,246 * | 3/1995 | Wilson et al. | 340/825.36 X |
| 5,627,515 | 5/1997 | Anderson . | |
| 5,736,928 | 4/1998 | Tice et al. | 340/511 |
| 5,889,468 | 3/1999 | Banga . | |

OTHER PUBLICATIONS

"Proposed Interface Specifications for Home Bus", *IEEE Transactions on Consumer Electronics*, vol. CE–32, No. 3, Aug. 1986 by M. Yoshitoshi N. Ayigase and S. Harada.

"Electrical Energy Monitoring and Control System for the Home", *IEEE Transactions on Consumer Electronics*, vol. CE–32, No. 3, Aug. 1986, by J. Hunt, J. Holmes R. Carr, and J. Daizell.

"The Residential Power Circuit as a Communication Medium", *IEEE Transactions on Consumer Electronics*, vol. CE–32, No. 3, Aug. 1986, by J. O'Neal, Center for Communications and Signal Processing Department of Electrical and Computer Engineering, North Carolina State University, Raleigh.

"Configuration and Performance of a Home Bus Using Slotted Flag Control", *IEEE Transactions on Consumer Electronics*, vol. CE–32, No. 3, Aug. 1986, by Y. Kishomoto, K. Yamamoto, Y. Yamazaki, H. Kishimoto, NTT Electrical Communications Laboratories, Japan.

"A Hybrid Coax and Twisted Pair Home Bus", *IEEE Transactions on Consumer Electronics*, vol. CE–32, No. 3, Aug. 1986, by N. Nakatani, H. Nakatsu, K. Tatematsu, Visual Information Systems Dev.Ctr., Matsushita Electric Ind. Co., Ltd.

"Ethernet: Distributed Packet Switching for Local computer Networks" CSL–75–7 May 1975, reprinted Feb. 1980, a version of this paper appeared in *Communications of the ACM*, vol. 19, No. 7, Jul. 1976, by R. Metcalfe and D. Boggs.

"Performance Analysis of a Retransmission Control Algorithm for Local Area Networks", *Computer Communications*, vol. 8, No. 3, Jun. 1985, pp. 128–140, by T. Apostolopoulos, E. Sykas and E. Protonotarios.

"A Technique for Adaptive Routing in Networks", *IEEE Transactions on Communications*, vol. COM–29, No. 4, Apr. 1981, pp. 474–480, by R. Boorstyn and A. Livne.

"Reverse Path Forwarding of Broadcast Packets", *Communications of the ACM*, vol. 31, No. 12, Dec. 1978, pp. 1040–1048, by Y. Dalai and R. Metcalfe.

"Advances in Verifiables Fail–Safe Routing Procedures", *IEEE Transactions on Communications*, vol. COM–29, No. 4. Apr. 1981, pp. 491–497, by A. Segall.

"The Need for Adaptive Routing in the Chaotic and Unbalanced Traffic Environment", *IEEE Transactions on Communications*, vol. COM–29, No. 4, Apr. 1981, pp. 481–490, by. W. Chou, A. Bragg, and A. Nilsson.

"An Analysis of Retransmission System", *IEEE Transactions on Communication Technology*, manuscript received may 11, 1964, pp. 135–145, by R. Benice and A. Frey.

"A carrier Sense Multiple Access Protocol for Local Networks", *Computer Networks*, vol. 4, No. 1, Feb. 1980, pp. 21–32, by S. Lam.

"Comparison of Hop–by–Hop and End–to–End Acknowledgement Schemes in Computer Communications Networks", *IEEE Transactions on Communications*, Nov. 1976, pp. 1258–1262, by Israel Gitman.

"Practical Considerations in Ethernet Local Network Design", Xerox Systems Development Division and Palo Alto Research Center, Palo Alto, CA, Oct. 1979, revised Feb. 1980, pp. 41–47, by R. Crane and E. Taft.

"Packet Radio Network Routing Algorithms: A survey", *IEEE Communications Magazine*, vol. 22, No. 11, Nov. 1984, pp. 41–47.

"Reliability of Packet Switching Broadcast Radio Networks", *IEEE Transactions of Circuits and Systems*, vol. CAS–23, No. 12, Dec. 1976, pp. 806–813, by M. Vall, R. Van Slyke, I. Gitman and H. Frank.

"Prevention of Deadlocks in Pack–Switched Data Transport Systems", *IEEE Transactions On Communications*, vol. COM–29, No. 4, Apr. 1981, pp. 512–524, by K. Gunther.
Computer Networks (Textbook), by Andrew S. Tanenbaum, pp. 249.295, (Chapters 6 and 7) ©1981 by Prentice–Hall, Inc.
"An American national Standard, IEEE Standards for Local Area Networks, Logical Link Control", (Standard 8802/2) pp. 77–111, Sponsor Technical Committee Computer of IEEE Computer society, ©1984 by the Institute of Electrical and Electronics Engineers, Inc., New York, N.Y.
"Congestion Control of Packet Communications Networks by Input Buffer Limits–A Simulation Study", *IEEE Transactions on Computers*, vol. C–30, No. 10, Oct. 1981, pp. 279–288, by s. Lam and Y.C. Luke Lien.
Explicit Path Routing in Communications Networks, The Proceedings of the International Conference on Computer Communications, 1976, pp. 340–342. by R. Jueneman and G. Kerr.
"Packet Switching in a Multiaccess Broadcast channel: Performance Evaluation", *IEEE Transactions on Communications*, vol. COM–23, No. 4, Apr. 1975, pp. 410–423, By L. Kleinrock and S. Lam.
"Housekeeping Application with Bus Lines and Telecommunication", *IEEE Transactions and Comsumer Electronics*, vol. CE–32, No. 3, Aug. 1986, by K. Lida, H. Yahiro and A. Kubo.
"A Analysis of Three–Dimensional CSMA/BT–CD Multihop Packet Radio Network", pp. 93–100, by R. Roy an T. Saadawa.
"Packet Broadcast Networks–A Performance Analysis of the R–ALOHA Protocol", *IEEE Transactions on Computers*, vol. C–29, No. 7, Jul. 1980. pp. 596–603, by S. Lam.
"A Bound and Approximation of Delay Distribution for Fixed–Length Packets in an Unslotted ALOHA Channel and a Comparison with Time Division Multiplexing (TDM)", *IEEE Transactions on Communications*, vol. COM–25, No. 1, Jan. 1977, pp. 136–139, by M. Ferguson.
"The Design and Analysis of a Demidynamic Deterministic Routing Rule", *IEEE Transactions on Communications*, vol. Com–29, No. 4, Apr. 1981, pp. 498,504, by Tak–Shing P. Yum.
Data Networks (Textbook), by D. Bertesekas, and r. gallagher, pp. 340–355, ©1987 by Prentice–Hall, Inc. "Address Selection by Combinatorial Decoding of Semiconductor Memory Arrays", *IEEE Journal of Solid–State Circuits*, vol. SC–4, No. 5, Oct. 1969, by F. Greene and W. Sander.
"A Local Network for Experiment Support", *National Electronics Conference*, vol. 36, 1982, pp. 356–362, by J. A. Davis, A. V. Pohn, I.S.M. Christiansen and G. D. Bridges.
Search Report under Section 17(5) dated Oct. 11, 2000 for Application No: GB 0012492.5.

* cited by examiner

MULTIPLE SENSOR SYSTEM FOR ALARM DETERMINATION WITH DEVICE-TO-DEVICE COMMUNICATIONS

FIELD OF THE INVENTION

The invention pertains to multi-unit monitoring systems. More particularly, the invention pertains to such systems which incorporate multiple programmed processors in bi-directional communication with one another for purposes of improving response time in monitoring selected ambient conditions.

BACKGROUND OF THE INVENTION

Monitoring and alarm systems are known for purposes of continuously supervising one or more regions with respect to the presence of preselected conditions. For example, intrusion or burglar alarm systems are known for the purposes of monitoring a premises and detecting unauthorized entry therein. Other types of monitoring systems which are known include fire or gas detecting systems, or systems for the monitoring or control of air flow or illumination.

It has also been recognized that preferably such systems will have the shortest possible response times so as to signal the existence of the selected condition as quickly as possible without generating false alarms or false positives. Various approaches are known and have been used to address these issues.

For example, one approach has been to preprocess signals from ambient condition sensors. An example of such an approach has been disclosed and claimed in Tice U.S. Pat. No. 5,736,928, entitled "Pre-Processor Apparatus and Method" assigned to the assignee hereof. Another known approach contemplates altering degrees of filtering of signals received from ambient condition sensors. One form of this approach has been disclosed and claimed in Tice U.S. patent application Ser. No. 09/120,444, filed Jul. 22, 1998 entitled "System and Method of Adjusting Smoothing", also assigned to the assignee hereof.

While known approaches have been found to be effective and useful in carrying out their purposes, there continues to be need for systems which can benefit from processing signals from multiple units which might be physically near where the ambient condition of interest is originating in the premises. Preferably such systems could provide shorter response times while minimizing false alarms without substantially increasing the manufacturing or installation costs thereof.

SUMMARY OF THE INVENTION

A multi-unit communication system incorporates a bi-directional communications medium. Examples of representative media include cable, either optical or electrical, or a wireless medium.

Units can include programmed processors coupled in bi-directional communication with the medium. Units can send and receive messages from other units via the medium. At least some of the units incorporate condition monitoring circuitry.

The receiving units can combine condition related information or messages received from other units. In this regard, for example, a selected receiving unit might include circuitry for storage of condition related information received from other units.

The receiving units also include circuitry for analyzing the received information, perhaps in combination with locally generated information from a condition sensor coupled to the receiving unit. The analysis can result in a determination that a preselected condition is indicated by the combined information.

In one aspect, the units can be implemented as programmed processors. In such an embodiment, stored executable instructions in combination with processor circuitry implement the bi-directional communication function as well as the analysis function.

In yet another aspect, a receiving unit can incorporate one or more thresholds, which might be adjustable, for purposes of determining if the combined condition-related information exhibits selected predetermined characteristics. In one embodiment, the units can transmit as condition-related information, indicia of the presence of a selected condition such as smoke or gas. The transmitted indicia can be combined at a receiving unit, along with a locally generated indicium indicating ambient smoke or gas to form a composite indication of the degree thereof in a preselected group of units or in a subregion being monitored.

In yet another aspect, output devices can be coupled to the medium. The output devices, which might incorporate programmed processors, include circuitry for producing human discernable indicators of the presence of predetermined conditions such as fire or gas. The indicators can be visual or audible. The output devices respond to and energize their respective output indicating elements based on messages received from one or more combining units via the medium.

Units, in yet another aspect of the invention can be grouped. Condition related information from the members of a selected group can be processed to establish a group determination as to presence of one or more preselected ambient conditions such as fire or gas.

A variety of processes can be used to establish the presence of the selected condition. For example, the results of the combination of received condition information at a selected receiving unit can be compared to one or more thresholds. Alternately, a unit which exhibits the greatest indicator based on combining received condition information can notify other units in the system of the presence of an alarm condition. Pattern recognition and/or fuzzy logic processing can also be used.

In yet another alternate, a control element can be coupled to the communication link. In addition to the processors communicating with one another, they can in turn communicate with the control element. The control element can in turn make a determination as to the existence of a preselected ambient condition.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENT

Figure 1:
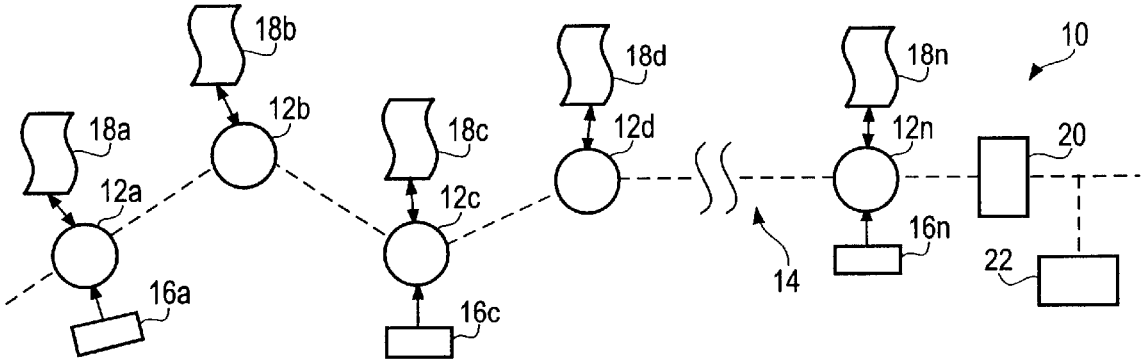
FIG. 1 illustrates a multi-unit communication system in accordance with the presence invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 in accordance with the present invention. The system 10 includes a plurality of electrical units 12*a,* 12*b* . . . 12*n.* At least some of the units are in bi-directional communication with other units via a communications medium indicated generally at 14. It will be understood that the nature of the medium is not a limitation of the present invention. The medium can be implemented using electrical or optical cables. Alternately, the ambient atmosphere can be used as a wireless medium.

At least some of the electrical units, such as 12*a,* 12*c,* 12*n* include local ambient condition sensors indicated as 16*a,* 16*c* and 16*n.* These ambient condition sensors can sense a variety of ambient conditions without limitation including motion, position, temperature, fire, gas or the like.

Those electrical units which include ambient condition sensors transmit local condition related, sensor generated information via medium 14 to other units in the system 10. Receiving units store, at least temporarily, condition related information received from other electrical units indicated generally at 18*a,* 18*b,* 18*c* . . . 18*n.* Information can be stored in binary storage units or in any other form of storage without departing from the spirit and scope of the present invention.

At least some of the units, such as 12*a,* 12*b,* 12*d* include circuitry for processing the stored ambient condition information. The stored ambient condition information can also be combined with locally generated ambient condition information from local sensors such as 16*a,* 16*c* . . . 16*n.*

The various electrical units also include circuitry which, in response to the combining process, determines if a selected criterion has been met. For example, and without limitation, the combined ambient condition information can be compared to an amplitude or a velocity threshold. Alternately, the combined information can be processed using pattern recognition or fuzzy logic processing to establish that the stored information, with or without locally generated ambient condition information corresponds to a predetermined criterion. The selected criterion could, for example, indicate the presence of a fire condition, a gas condition or an intrusion without limitation.

More specifically, information 18*a* received from other units could be added together with condition information received from sensor 16*a* and compared to a predetermined threshold value. Alternately, all of the information 18*a* could be input along with information from sensor 16*a* to a pattern recognition process to determine if a predetermined fire or gas profile is present.

One or more electrical units which has established that a predetermined criterion has been met can transmit messages, via medium 14, to, for example, an output device 20 also coupled to the medium 14. The device 20 could, for example, be a visual-type output device such as a blinking indicator or a strobe or an audible output device such as a loudspeaker, a horn, a siren or the like, without limitation. In response to a received message or messages, via medium 14, the output unit 20 could in turn energize one or more output devices, providing a human perceptible indication of the presence of a predetermined condition.

If desired, a common control element 22, coupled to medium 14, can be provided to transmit instructions or commands and to receive data from the electrical units 12*a,* 12*b* . . . 12*n.* The form of the common control unit 22, which could be implemented as one or more programmed processors, is not a limitation of the present invention.

It will be understood that the electrical units 12*a,* 12*b* . . . 12*n* in accordance herewith are capable of receiving messages from other electrical units in the system in connection with sensed ambient conditions, processing one or more of the received messages, along with perhaps locally generated ambient condition information. A respective unit can make a determination that the processed information is indicative of the presence of a predetermined condition.

It will also be understood that various of the electrical units such as 12*a,* 12*b* and 12*c* could be grouped and carry out processing relative to messages received only from group members. In this regard, unit 12*c,* upon receipt of appropriate messages from units 12*a,* 12*b* could carry out group related processing of that information to determine if the group information exhibits a predetermined criterion or profile.

Electrical units such as unit 12*c* can be members of one or more groups without limitation. Hence, a given electrical unit, such as 12*c,* could carry out group related processing relative to units 12*a,* 12*b* and 12*c* as well as group related processing of units 12*c,* 12*d* . . . 12*n* without limitation. It will also be understood that the common control element 22, if present, could be used to establish groups of electrical units 12*a* . . . 12*n.*

Figure 2:
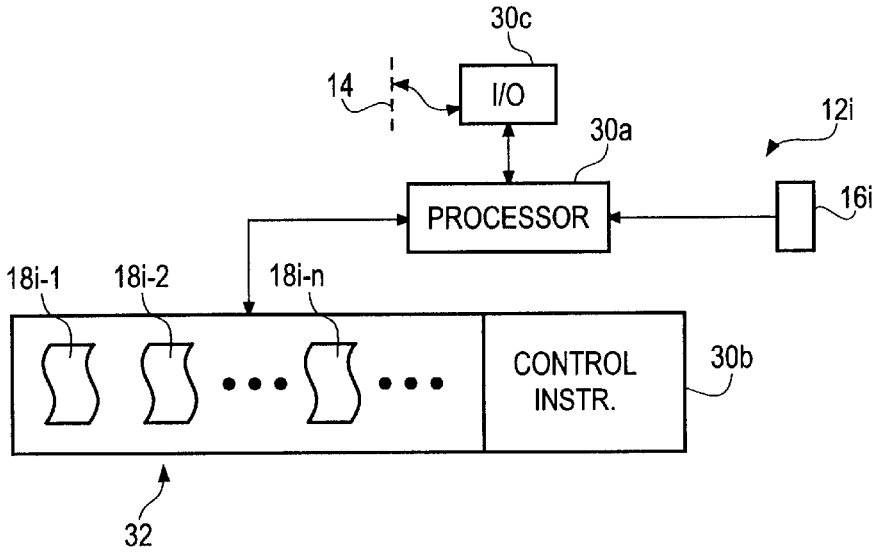
FIG. 2 is a block diagram of a representative unit usable in the system of FIG. 1.

FIG. 2 is a block diagram of a selected electrical unit 12*i.* Unit 12*i* includes a programmable processor 30*a* which can execute prestored instructions 30*b.* Coupled to processor 30*a* is input/output circuit circuitry 30*c.* Where for example, the medium 14 was implemented as some form of a bi-directional communications cable, circuitry 30*c* would include appropriate interface circuits for coupling signals to and receiving signals from the cable. In the event that the medium 14 was wireless circuitry 30*c* would include an appropriate wireless transmitter and receiver or transceiver.

Coupled to processor 30*a* is an ambient condition sensor 16*i.* The executable instructions 30*b* are stored in one or more storage units indicated generally at 32. The unit or units 32 could be implemented with a variety of circuitry including read/write circuitry or read only memory or programmable read only memory without departing from the spirit and scope of the present invention.

A portion of the unit 32 includes storage circuitry wherein one or more sets of received ambient condition information 18*i*-1, -2 . . . -n received via medium 14 can be stored. Each of the sets of stored information, such as 18*i*-2, could represent ambient condition information associated with a group which includes processor 30*a.* Hence, as illustrated, processor 30*a* could be included in each of groups I, II, . . . n.

Control instructions 30*b* in addition to implementing communications with other units, via medium 14, also process received ambient condition information, stored at least temporarily in unit 32. The processing carried out by instructions 30*b* is to determine if selected sets of ambient condition information, which might include information from sensor 16*i,* correspond to a predetermined criterion as discussed above.

For example, and without limitation, if the sensors 16*a,* 16*c,* 16*i* . . . 16*n* were smoke sensors and units 12*a,* 12*c,* 12*i* and 12*n* were in the same group, respective ambient condition information might be stored in a portion of storage unit 32 indicated generally at 18*i*-2. That information could in turn be processed by instructions 30*b* by comparing some processed form of that information to a predetermined amplitude or velocity threshold to establish the presence of a fire condition. Alternately, the information could be coupled to pattern recognition processing instructions or fuzzy logic-type processing instructions. Such processing could be used to determine if a fire profile had been detected.

In the event that the unit 12*i* determines the presence of a selected condition, input/output circuitry 30*c* can be used to transmit via medium 14 a condition indicating message to output unit 20. Output unit 20 can in turn energize one or more audible or visible output devices so as to provide a human discernable indication of the presence of the selected condition. It will be understood that unit 20 could incorporate a processor driven by executable instructions in combination with a strobe unit or audible alarm unit.

Figure 3:
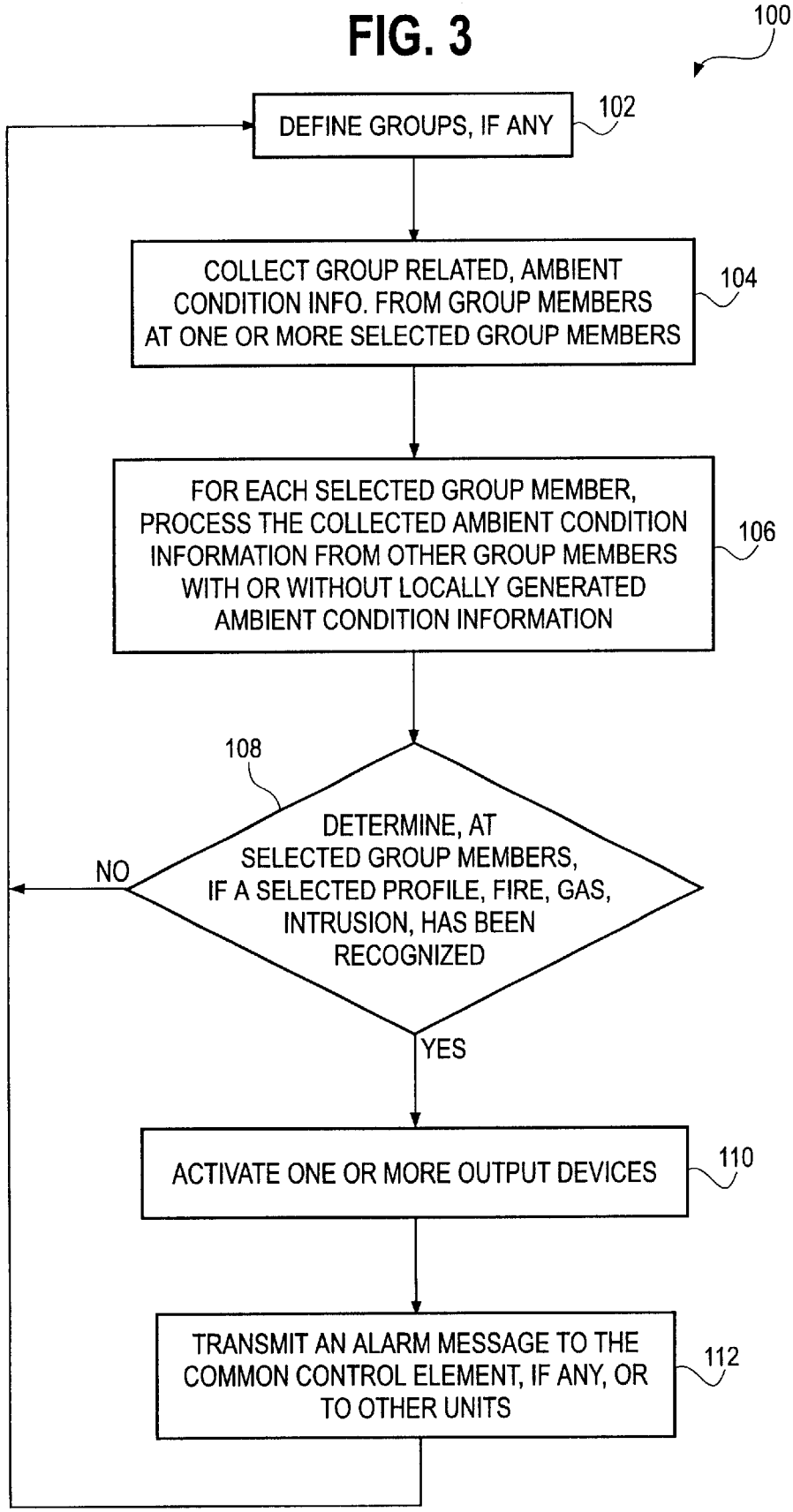
FIG. 3 is a flow diagram illustrating selected processing aspects implementable in the system of FIG. 1.

FIG. 3 is a flow diagram illustrating exemplary processing 100 of the system 10. In a step 102, groups can be defined if desired. If no groups are defined, then the entire plurality of units can be treated as being in a common group.

In a step 104, group related ambient condition information from group members is collected at one or more selected group members. For example, all members of the group can collect transmitted ambient condition information from other group members.

In a step 106, the collected ambient condition information is processed at the respective member or members with or without that group member's locally generated ambient condition information.

In a step 108, the selected group members determine if a selected profile indicative of fire, gas, intrusion or the like has been recognized. If so, in a step 110, one or more output devices can be activated. In a step 112, an alarm message can be transmitted to the other units and to the common control unit if present.

Figure 4:
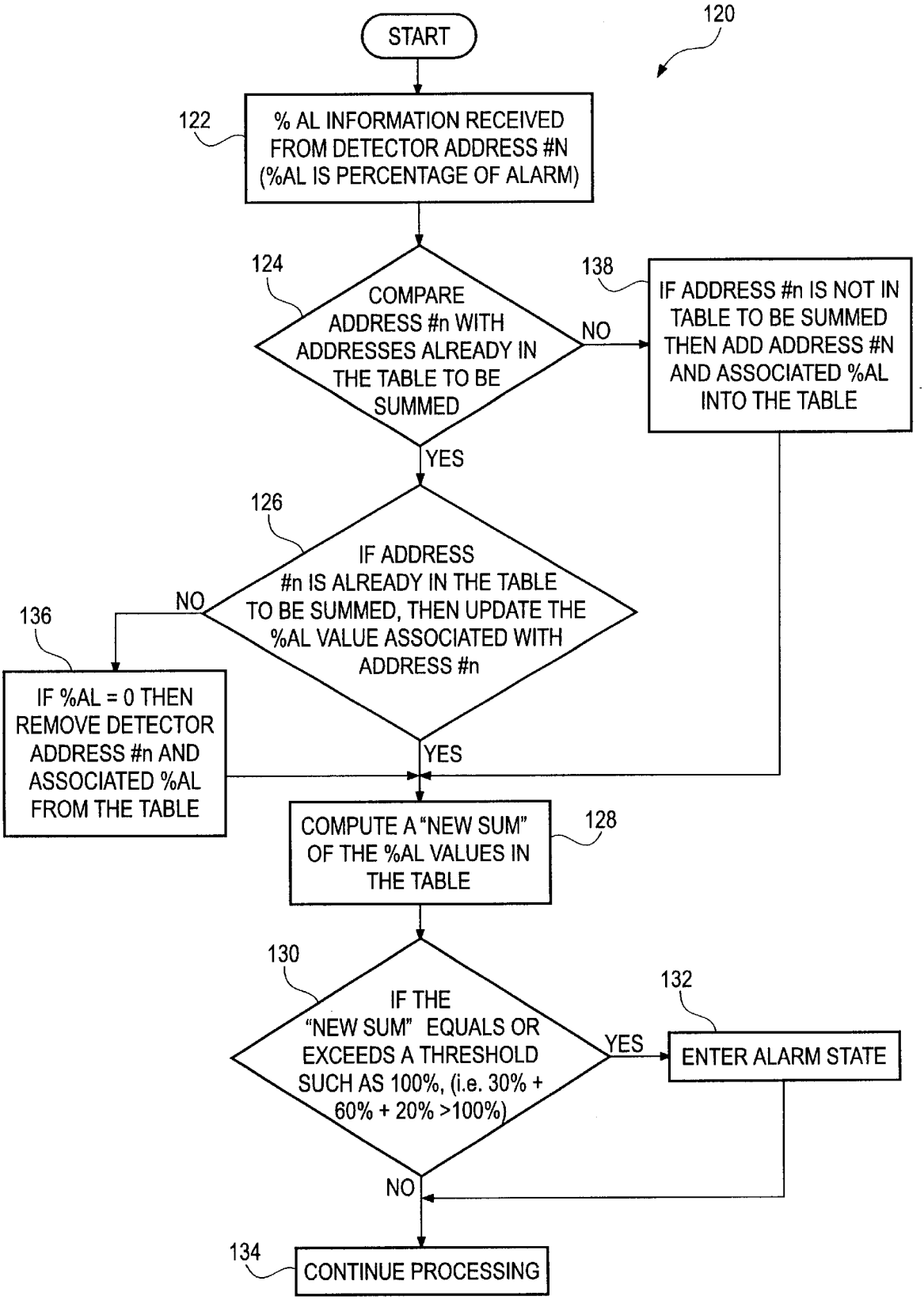
FIG. 4 is a block diagram illustrating in more detail the processing step of FIG. 3.

FIG. 4 is a block diagram of a process 120, which discloses further details of processing step 106 in FIG. 6. At a selected detector, for example detector 1, ambient condition information is received, step 122, from detector n.

The received information is in a form which corresponds to a processed value of the output signal from the ambient condition sensor of detector n. That signal might have been processed to remove noise and other transients. It could have been compared to a pre-established threshold to produce a signal indicative of a percent of a value of interest. One type of threshold is an alarm threshold where detector n would normally be expected to be signalling the presence of an alarm condition. Another type is a pre-alarm threshold. Where detector n is a fire detector, the percent of alarm signal is an indication of how close the parameter being measured, such as smoke, heat, gas, and light is to indicating the existence of a fire.

It will also be understood that the receiving detector, such as detector 1, or other receiving electrical unit could determine the percent of alarm if it has a record of the sensitivity of the transmitting detector. It will be understood that the exact form of the information received at detector 1 is not a limitation of the present invention.

In a step 124 at the receiving detector, the address of the transmitting detector is compared with addresses previously stored in a table. The table includes, for example, those members of a group with which detector 1 is associated. The signals associated with the addresses in the table are to be combined together, such as by being summed, or by taking differences or ratios to evaluate rates of change either over time relative to a selected transmitting detector or at the same time between different detectors.

In a step 126, if the address of detector n has already been entered into the table, the current percentage of alarm value is used to update the value in the table. In a step 128, the values in the table can be processed by summing the updated percentage of alarm values for the detectors in the table. In a step 130, the result of the summing process of step 128 can be compared to one or more preselected values. The preselected values can correspond to predetermined prealarm or alarm conditions.

In step 130, for example, percentage of alarm signals from three detectors indicative of 30%, 60%, and 20% have been summed producing a value in excess of 100% which corresponds to an alarm state which could be entered in step 132. In the event that the sum from step 128 falls below the predetermined threshold or thresholds, processing continues in step 134.

If in the step 126, the percentage of alarm signal received from detector n corresponds to clear air or zero, the entry can then be removed from the table in a step 136. If in the step 124 a determination is made that the address of detector n is not in the table, it can be entered, if appropriate, in a step 138. For example, detector n can be newly assigned to the group associated with the detector 1. In such instance, it would be appropriate to enter the address of detector n into the table in step 138.

Examples 1 through 3 are indicative of processing at detector 1 as illustrated in FIG. 4 for different detector addresses and for different percentage of alarm conditions received at detector 1. "% A1" corresponds to signals received from detectors where the respective detector compares a sensor output signal to a selected threshold, for example a pre-alarm or an alarm threshold.

It will be understood that the exact form of processing carried out at detector 1 based on the received values is not a limitation of the present invention. For example, processing could include summing as discussed previously as well as other processing including forming averages, filtering the received signals or evaluating rate of change of information without limitation. Where respective detectors transmit a percent of alarm (% A1) signal, such signals are sensitivity independent. Outputs from different types of detectors or detectors having different sensitivities can be directly combined and processed when expressed in a % A1 format.

EXAMPLE 1 = 30% received from detector #10

| Old Table | | New Table | |
|---|---|---|---|
| Address | % Al | Address | % Al |
| 8 | 20 | 8 | 20 |
| 10 | 20 | 10 | 30 |
| 14 | 30 | 14 | 30 |
| Sum = | 70 | Sum = | 80% |

EXAMPLE 2 = 30% received from detector #18

| Old Table | | New Table | |
|---|---|---|---|
| Address | % Al | Address | % Al |
| 8 | 20 | 8 | 20 |
| 10 | 20 | 10 | 20 |
| 14 | 30 | 14 | 30 |
| Sum = | 70 | Sum = | 100% |

| EXAMPLE 3 = 0% received from detector #8 | | | |
|---|---|---|---|
| Old Table | | New Table | |
| Address | % Al | Address | % Al |
| 8 | 20 | — | — |
| 10 | 20 | 10 | 20 |
| 14 | 30 | 14 | 30 |
| Sum = | 70 | Sum = | 50% |

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A system comprising:

a bi-directional communications medium; and a plurality of programmed units coupled to the medium wherein at least some of the units include circuitry for transmitting and receiving information to/from the communications medium, wherein selected ones of the units include ambient condition sensors and alarm determination circuitry, wherein some of the programmed units transmit ambient sensor output information via the communications medium, wherein some of the programmed units receive and store the sensor output information received from the communications medium; and wherein multiple units that receive and store the sensor output information transmitted via the communications medium include circuitry for combining that information at the respective detector to determine if an alarm condition is present.

2. A system as in claim 1 wherein the receiving unit includes circuitry for summing the sensor outputs together and comparing that sum to a predetermined level above which an alarm condition is determined.

3. A system as in claim 1 wherein the programmed units substantially simultaneously combine received and stored sensor output information to determine if an alarm condition is present in the system.

4. A system as in claim 1 wherein at least some of the programmed units include circuitry for processing the ambient condition sensor output values prior to determining and transmitting sensor output information.

5. A system as in claim 4 wherein the circuitry includes one of, a microprocessor and a microcontroller.

6. A system as in claim 4 wherein the processing includes smoothing of the sensor signals.

7. A system as in claim 1 wherein circuitry for combining the received sensor output information determines a rate of change of the sensor output information for the combination and compares that rate of change with a predetermined rate of change to determine if the comparison indicates a predetermined relationship.

8. An ambient condition monitoring system comprising:

a communications medium; and a plurality of ambient condition detectors wherein the detectors include circuitry for transmitting messages on the medium, wherein at least some of the messages pertain to sensed ambient conditions and circuitry for receiving messages transmitted on the medium by other detectors wherein at least some of the messages pertain to ambient conditions sensed at the respective transmitting detectors and wherein at least one of the detectors includes circuitry for establishing the existence of a selected ambient condition in response, at least in part, to received messages from other detectors.

9. A system as in claim 8 wherein the at least some detectors each include a storage unit wherein representations of received ambient condition indicating messages are stored.

10. A system as in claim 8 wherein the at least some detectors each include a programmed processor and prestored instructions for carrying out the establishing process.

11. A system as in claim 10 wherein medium comprises a cable and wherein the detectors include circuitry for coupling to the cable.

12. A system as in claim 10 wherein the medium comprises the atmosphere and wherein the detectors include wireless transmitters.

13. A system as in claim 8 wherein at least some of the detectors include at least one sensor of the ambient condition.

14. A system as in claim 13 wherein at least some of the sensors comprise smoke sensors.

15. A system as in claim 8 which includes at least one condition indicating output device.

16. A system as in claim 15 wherein the output device includes activation circuitry responsive to a message received via the medium.

17. A system comprising:

a bi-directional communications medium;

a plurality of programmed units coupled to the medium wherein selected of the units include condition monitoring circuitry, and circuitry for receiving messages transmitted via the medium from other units and wherein the selected message receiving units include prestored instructions for combining condition related information received from other units.

18. A system as in claim 17 wherein message receiving units include circuitry for establishing if the combined condition corresponds to a predetermined criterion.

19. A system as in claim 17 wherein a selected one of the other of the units includes at least one of an audible output device and a visible output device.

20. A system as in claim 17 wherein the selected unit includes prestored instructions for activating the output device in response to an activating message received via the medium.

21. A system as in claim 17 wherein the activating message originates from one of the information combining units and wherein the one unit includes circuitry for transmitting the activating message.

22. A system as in claim 18 wherein the message receiving units include circuitry for transmitting a message indicative of corresponding to the predetermined criterion.

23. A system as in claim 18 which includes a control element coupled to the medium wherein the control element includes circuitry for responding to a selected combined condition.

24. A system as in claim 17 wherein the medium comprises one of an optical or an electrical cable.

25. A system as in claim 17 wherein the message receiving units include storage and executable instructions for storing, at least temporarily, condition relate information received from other units.

26. A system as in claim 25 wherein at least some of the message receiving units include evaluation instructions for determining, in response at least in part to stored condition related information, if a selected condition related criterion has been met.

27. A system as in claim 26 wherein the condition is selected from a class which includes intrusion, fire and gas.

28. A system as in claim 27 wherein the criterion comprises a selected degree of a selected type of condition.

29. A system as in claim 28 which includes an output device, responsive, at least indirectly, to the criterion having been met for providing a human discernable indicator thereof.

30. An electrical unit comprising:

a control element;

circuitry for storing information pertaining to ambient conditions sensed at other displaced units, at least one local condition sensor coupled to the control element; and prestored instructions for combining stored condition related information received from other units with information received from the local sensor for determining if a predetermined criterion has been met.

31. A unit as in claim 30 which includes communication circuitry for transmitting information to and receiving information from other units.

32. A unit as in claim 30 wherein the control element includes a programmed processor and instructions for carrying out bi-directional communications.

33. A unit as in claim 30 wherein the sensor is one of a smoke sensor, a thermal sensor, a motion sensor, a position sensor, a pressure sensor, a gas sensor and a waterflow sensor.

34. A unit as in claim 30 wherein the instructions for determining carry out at least one of a comparison to at least one threshold, a pattern recognition process and a fuzzy logic process.

35. A unit as in claim 34 wherein the threshold comprises one of an amplitude value, and a rate of change value.

36. A unit as in claim 34 which includes instructions, responsive to the determining instructions, for transmitting a condition detected message to at least one other unit.

37. A unit as in claim 31 wherein the communication circuitry includes circuitry for interfacing to one of a wired medium and a wireless medium.

38. An ambient condition monitoring system comprising:

a communications medium; and a plurality of ambient condition detectors wherein the detectors include circuitry for transmitting messages on the medium wherein the messages pertain, at least in part, to sensed ambient conditions and circuitry for receiving messages transmitted on the medium by other detectors wherein at least some of the messages pertain to ambient conditions sensed at the respective transmitting detectors and wherein at least some of the detectors include prestored instructions for establishing the existence of a selected ambient condition in response, at least in part, to received messages received from other detectors.

39. A system as in claim 38 wherein the at least some detectors each include a storage unit wherein representations of received ambient condition indicating messages are stored.

40. A system as in claim 38 wherein the at least some detectors each include a programmed processor and prestored instructions for carrying out a communications process.

41. A system as in claim 40 wherein the medium comprises a cable and wherein the detectors include circuitry for coupling to the cable.

42. A system as in claim 40 wherein the medium comprises the atmosphere and wherein the detectors include wireless transmitters.

43. A system as in claim 38 wherein at least some of the detectors include at least one sensor of the ambient condition.

44. A system as in claim 43 wherein at least some of the sensors comprise smoke sensors.

45. A system as in claim 38 which includes at least one condition indicating output device.

46. A system as in claim 45 wherein the output device includes activation circuitry responsive to a message received via the medium.

47. A system comprising:

a bi-directional communications medium;

a plurality of programmed processors coupled to the medium wherein selected of the processors include both condition monitoring circuitry, and circuitry for receiving messages transmitted via the medium from other processors and wherein the selected message receiving processors include prestored instructions for combining condition related information received from other processors wherein multiple selected processors independently combine condition related information from other processors; and at least one output device.

48. A system as in claim 47 wherein the message receiving processors include circuitry for establishing if the combined condition corresponds to a predetermined criterion.

49. A system as in claim 47 wherein the output device includes at least one of an audible output element and a visible output element.

50. A system as in claim 47 wherein a selected processor includes prestored instructions for activating the output device in response to an activating message received via the medium.

51. A system as in claim 50 wherein the activating message originates from one of the information combining processors and wherein the one processor include circuitry for transmitting the activating message.

52. A system as in claim 48 wherein the message receiving processors include circuitry for transmitting a message indicative of corresponding to the predetermined criterion.

53. A system as in claim 48 which includes a control element coupled to the medium wherein the control element includes circuitry for responding to a selected combined condition.

54. A system as in claim 47 wherein the medium comprises one of an optical or an electrical cable.

55. A system as in claim 47 wherein the message receiving processors include storage and executable instructions for storing, at least temporarily, condition related information received from other processors.

56. A system as in claim 55 wherein at least some of the message receiving processors include evaluation instructions for determining, in response at least in part to stored condition related information, if a selected condition related criterion has been met.

57. A system as in claim 56 wherein the condition is selected from a class which includes intrusion, fire and gas.

58. A system as in claim 57 wherein the criterion comprises a selected degree of a selected type of condition.

59. A system as in claim 58 wherein the output device is responsive, at least indirectly, to the criterion having been met and for providing a human discernable indication thereof.

60. A method of detecting a selected condition comprising:

sensing, at a plurality of spaced apart locations, an ambient condition;

transmitting condition information between the locations and;

collecting transmitted information at multiple sensing locations; and processing the collected information at the multiple locations and determining if the processed information exhibits a preselected profile.

61. A method as in claim 60 including, in response to the determining step, producing a human discernable indicia of the condition.

62. A method as in claim 60 wherein the determining step includes comparing the processed information to at least one of an amplitude value and a rate of change value.

63. A method as in claim 60 which includes, in the processing step, combining the collected values.

64. A method as in claim 60 which includes, in the processing step, carrying out one of pattern recognition processing and fuzzy-logic type processing.

65. A method as in claim 60 wherein the collecting step includes associating at least some of the collected information with at least one predefined group.

66. A method as in claim 65 wherein the processing step includes processing group related information and determining if the group related information exhibits the profile.

67. A system comprising:

a bi-directional communications medium;

a plurality of programmed units coupled to the medium wherein at least some of the units include circuitry for transmitting and receiving information from the communications medium, wherein at least some of the units include ambient condition sensors and levels of alarm determination circuitry, wherein some of the programmed units transmit levels of alarm information via the communications medium, and wherein some of the programmed units receive and store the levels of alarm information transmitted via the communications medium from other units; and wherein the programmed units which receive and store the levels of alarm information transmitted via the communications medium combine the stored level of alarm information to determine if an alarm condition is present.

68. A system as in claim 67 wherein the information receiving programmed unit combines the received level of alarm information from other devices with its own level of alarm in determining if an alarm condition is present.

69. A system as in claim 67 wherein the receiving unit includes circuitry for summing the levels of alarm together and comparing that sum to a predetermined level which determines an alarm condition.

70. A system as in claim 67 wherein the programmed units substantially simultaneously combine received and stored level of alarm information to determine if an alarm condition is present in the system.

71. A system as in claim 67 wherein at least some of the programmed units contain circuitry for processing the ambient condition sensor values prior to determining and transmitting a level of alarm.

72. A system as in claim 71 wherein the circuitry includes a programmed processor.

73. A system as in claim 71 wherein the processing includes smoothing of the sensor signals.

74. A system as in claim 67 wherein circuitry for combining the received level of alarm information determines a rate of change of the combination and compares that rate of change with a predetermined rate of change to determine if the comparison indicates a predetermined relationship.

75. A system as in claim 67 wherein the levels of alarm are selected from a class which includes 0%, 30%, 50%, 60%, 70%, 80%, 90%, and 100% of alarm.

76. A system as in claim 75 wherein additional levels of alarm may be specified.

77. A monitoring system comprising:

a transmission medium;

a plurality of ambient condition detectors coupled to the medium wherein the detectors include executable instructions for coupling condition information from the respective detector to the medium to be received by other members of the plurality and for receiving and locally storing condition information from other members of the plurality.

78. A system as in claim 77 wherein the members of the plurality each include executable instructions for replacing a previously stored condition value, received from and associated with a selected different detector with an updated value therefrom.

79. A system as in claim 77 wherein at least some of the members of the plurality include executable instructions which combine local condition values with condition values received from other members of the plurality to independently make alarm determinations at multiple detectors.

80. A system as in claim 79 wherein members of the plurality include executable instructions for identifying at least one group to which the respective detectors are assigned and for using condition values from group members, along with local condition values, in making independent alarm determinations.

81. A system as in claim 79 wherein at least some of the members of the plurality incorporate different types of sensors and include executable instructions for producing condition indicating values in a common format whereby outputs from different types of sensors at different detectors, can be combined at respective detectors in making multiple independent alarm determinations.

* * * * *